US006328250B1

(12) United States Patent
Dickhoff

(10) Patent No.: US 6,328,250 B1
(45) Date of Patent: Dec. 11, 2001

(54) METHOD OF MOUNTING CORONA WIRE A CORONA CHARGER HOUSING OF AN ELECTROPHOTOGRAPHIC APPARATUS AND AN APPARATUS FOR MOUNTING CORONA WIRES

(75) Inventor: Andreas Dickhoff, Rochester, NY (US)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 09/280,119

(22) Filed: Mar. 26, 1999

(51) Int. Cl.[7] ..... B65H 49/34; B65H 57/12; B65H 75/00

(52) U.S. Cl. ..... 242/564.5; 242/588.2; 140/123

(58) Field of Search ..... 242/564.5, 564.4, 242/588, 588.1, 588.2, 588.6, 442, 916; 140/123, 124; 228/41, 52, 244; 226/127, 128–133

(56) References Cited

U.S. PATENT DOCUMENTS

| | | | | |
|---|---|---|---|---|
| 1,240,448 | * | 9/1917 | Hensley | 242/442 |
| 2,474,463 | * | 6/1949 | Burrell | 140/123 |
| 2,551,135 | * | 5/1951 | Justice | 242/442 |
| 2,649,256 | * | 8/1953 | Skrebba | 242/564.4 |
| 3,211,189 | * | 10/1965 | Wheeler | 140/123 |
| 3,211,355 | * | 10/1965 | Zoltai | 228/52 |
| 3,578,970 | | 5/1971 | Michaud et al. | 399/169 |
| 3,840,744 | | 10/1974 | Hedman, Jr. | 399/100 |
| 3,913,630 | * | 10/1975 | Rubey | 140/123 |
| 4,112,298 | * | 9/1978 | Weikel, Jr. . | |
| 4,177,555 | * | 12/1979 | Weltman | 140/124 |
| 4,258,258 | * | 3/1981 | Laing et al. . | |
| 4,418,875 | * | 12/1983 | Brine | 140/124 |
| 4,507,545 | * | 3/1985 | Riordan | 226/128 |
| 4,531,682 | * | 7/1985 | Schroder et al. | 242/564.5 |
| 4,603,964 | | 8/1986 | Swistak | 399/169 |
| 4,885,466 | | 12/1989 | Koichi et al. | 399/34 |
| 4,944,464 | * | 7/1990 | Zelenka | 242/588.2 |
| 5,023,748 | | 6/1991 | Okamoto et al. | 399/100 |
| 5,140,367 | * | 8/1992 | Oleksinski et al. . | |
| 5,181,069 | * | 1/1993 | Oleksinski et al. . | |
| 5,337,131 | | 8/1994 | Sagiv et al. | 399/170 |
| 5,358,165 | * | 10/1994 | Andoh . | |
| 5,392,099 | | 2/1995 | Kusumoto et al. | 399/100 |
| 5,424,540 | * | 6/1995 | Garcia et al. . | |
| 5,893,529 | * | 4/1999 | Bradersen et al. | 242/564.5 |
| 6,027,068 | * | 2/2000 | Lantsman | 242/564.4 |

* cited by examiner

*Primary Examiner*—John M. Jillions

(57) ABSTRACT

An apparatus for mounting corona wires in a corona charger comprises a wire dispenser pen with an inner wall forming a hollow shaft adapted to receive the wire; and a support structure attached to the wire dispenser pen. The support structure is adapted to receive a spool of wire.

12 Claims, 8 Drawing Sheets

METHOD OF MOUNTING CORONA WIRE A CORONA CHARGER HOUSING OF AN ELECTROPHOTOGRAPHIC APPARATUS AND AN APPARATUS FOR MOUNTING CORONA WIRES

CROSS REFERENCE TO RELATED APPLICATIONS

Reference is made to commonly assigned, U.S. patent application Ser. No. 09/277430, filed Mar. 26, 1999, entitled A CORONA CHARGER WITH A SERPENTINE STRUNG CORONA WIRE, by Andreas Dickhoff; U.S. patent application Ser. No. 09/280121, filed Mar. 26, 1999, entitled AN APPARATUS AND METHOD OF ATTACHING CORONA WIRE TO CORONA CHARGER HOUSING, by Andreas Dickhoff; and U.S. patent application Ser. No. 09/277,618, filed Mar. 26, 1999, now U.S. Pat. No. 6,108,504 entitled CORONA WIRE REPLENISHING MECHANISM, by Andreas Dickhoff, filed concurrently herewith.

FIELD OF THE INVENTION

The invention is in the field of electrophotography. More specifically, it is directed to a method and apparatus for mounting wires into a corona charger housing.

BACKGROUND OF THE INVENTION

A corona charger is used to generate an electrostatic charge on a surface, for example, a sheet of paper, a photoconductor or a transport web. A corona charge typically includes one or more tightly strung corona wires. The two ends of each wire are firmly attached to the corona charger housing, for example, by copper lugs, or by manually twisted loops which are connected to the corona charger housing. Applying high voltage to these corona wires creates the requisite charge.

The corona wires are usually mounted one by one. Mounting and adjusting the tension of each wire independently of other wires is time consuming and relatively expensive. In the mounting process the wire is touched multiple times by tools or by the operator's hand. The mounting process includes unpacking the wire, mounting one end of each wire into the corona charger, attaching a tensioning spring to the other end of each wire, and mounting this other end of each wire and the tensioning spring into the corona charger housing.

U.S. Pat. Nos. 4,112,298, 4,258,258, 5,140,367, 5,181,069, 5,358,165, and 5,424,540 describe a corona charger that utilizes individual wires strung to produce separate corona wire strings. These patents do not disclose the process of assembling these wires. FIG. 1 illustrates an OCE charger, including a five string corona wire strung in a serpentine manner. The corona wire is mounted on four grooved sleds, each of which is tensioned by a spring.

The tension of each spring has to be properly adjusted. This requires that some or all of these springs be adjusted several times, making it time consuming and relatively expensive to properly tension the corona wire.

Furthermore, the usual way of mounting corona wires in a corona charger is difficult and time consuming because these wires are thin and are easily damaged by handling. Even small damage to the wires can cause breakage or non-uniformity in the charge generated. Finally, the wires need to be renewed regularly because of contamination damage.

SUMMARY OF THE INVENTION

It is an object of the present invention to provide a tool for stringing corona wires in a charger, so that the direct handling of corona wires is minimized. It is also an object of the present invention to provide an improved method of stringing a corona wire in a corona charger housing.

According to one aspect of the present invention, an apparatus for dispensing wire includes a wire dispenser pen with inner wall forming a hollow shaft adapted to receive a wire and a support structure attached to the wire dispenser pen. This support structure is adapted to receive a spool of wire.

According to a preferred embodiment of the present invention the support structure includes a pin adapted to receive and to rotably support a spool of wire. The apparatus further includes a rotating spool roller. The spool roller has at least two positions, one of which enables it to be in contact with the spool of wire and the other which enables the spool of wire to be placed onto a rotating pin and into the support structure.

According to another aspect of the present invention, a method of mounting a corona wire into a corona charger housing from a spool tool comprises: (i) supporting a spool tool that includes a spool and wire dispenser pen; (ii) feeding a wire out of the wire dispenser pen and securing an open end of the wire to the corona charger housing; (iii) moving the spool tool to another section of the corona charger housing while feeding more wire out of the wire dispenser pen and stringing the wire across the corona charger housing; and (iv) securing a second end of the wire to the corona charger housing.

According to a preferred embodiment, prior to securing the second end of the wire, the spool tool is moved around at least one wire mount, producing at least two strings of corona wire in the corona charger housing.

It is an advantage of the present invention that it minimizes damage to fragile corona wires and simplifies mounting of corona wires in a corona charger housing.

DETAILED DESCRIPTION OF THE INVENTION

According to one embodiment of the present invention a spool tool 10 contains a corona wire 20. This spool tool 10 automatically feeds the desired amount of wire for mounting into the corona charger housing 25, minimizing the direct handling of corona wire. (See FIGS. 2 and 3).

Figure 4:
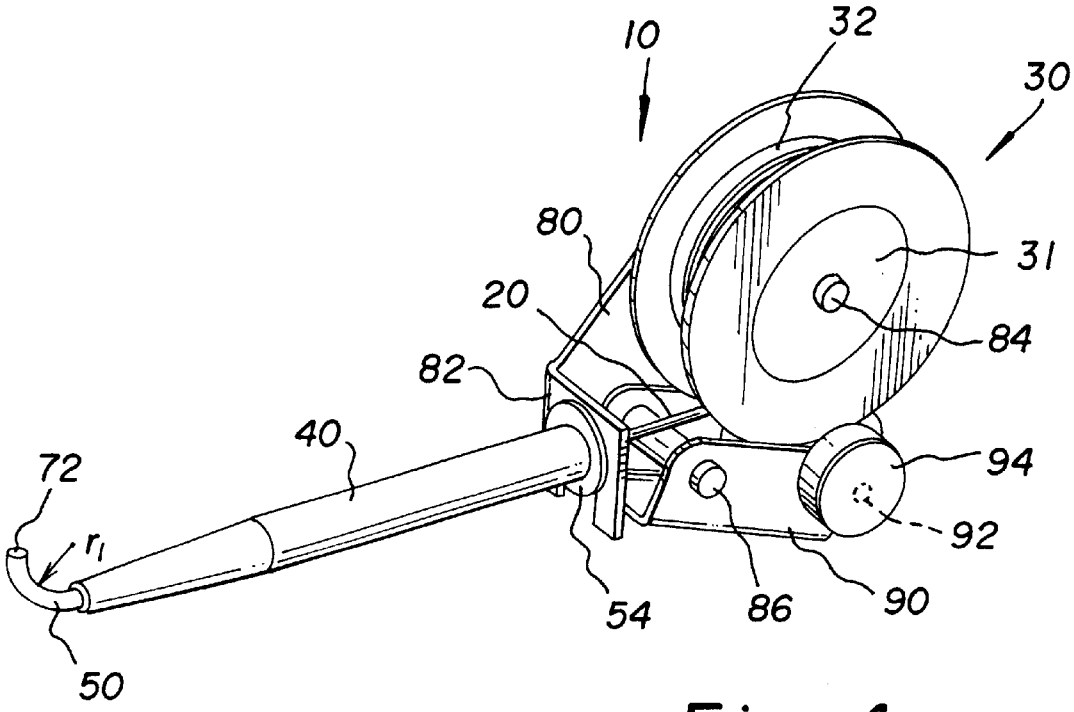
FIG. 4 is a perspective view of a spool tool according to one embodiment of the present invention.
Figure 5:
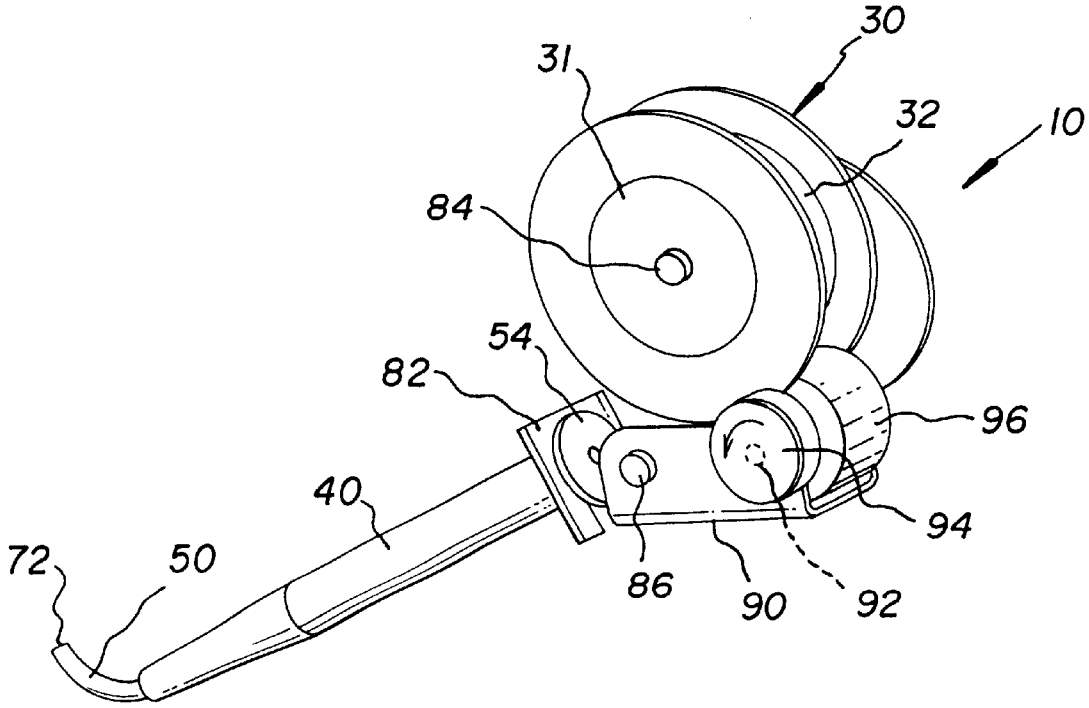
FIG. 5 is another perspective view of the spool tool of FIG. 4.
Figure 6:
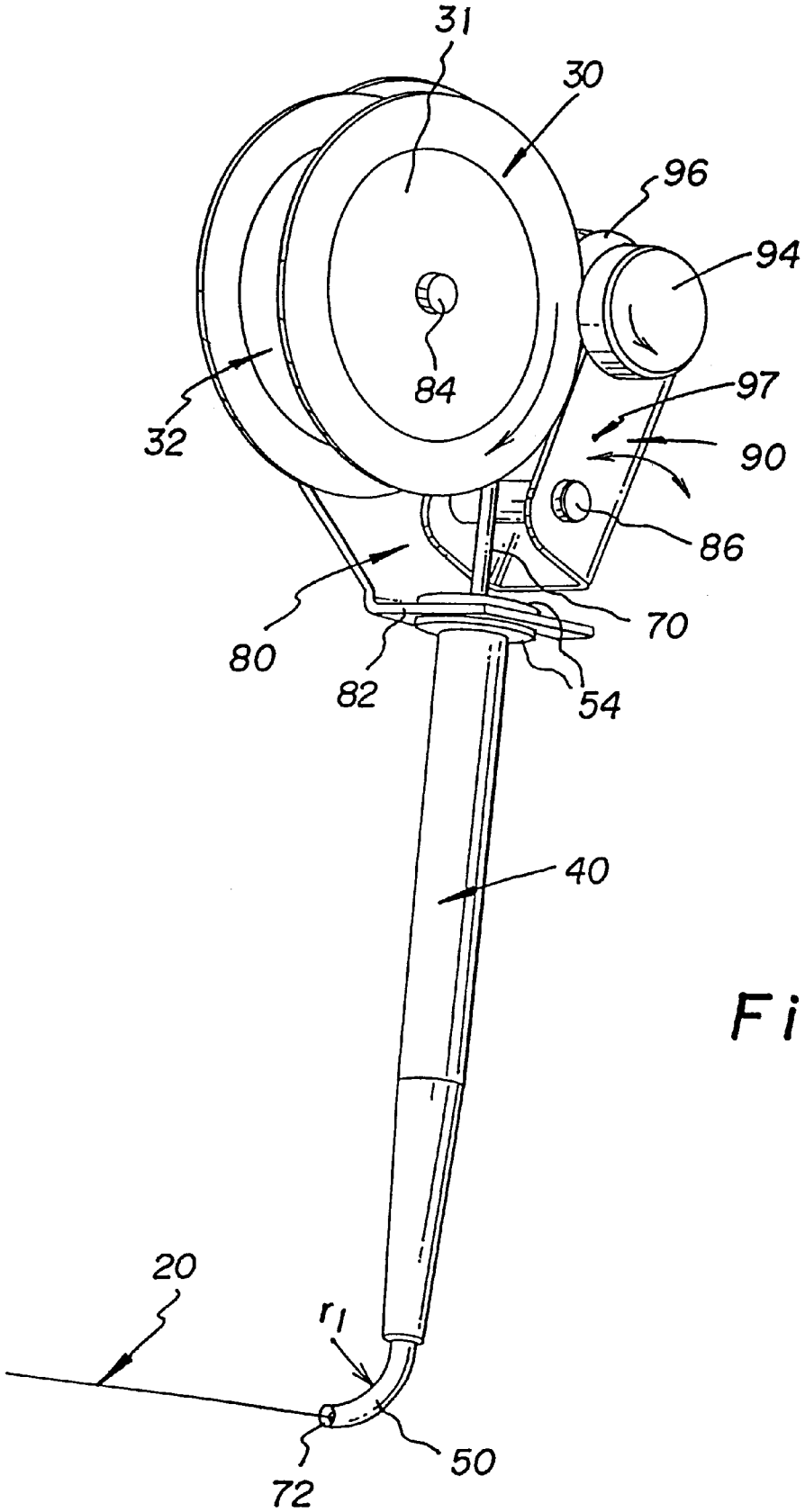
FIG. 6 shows orientation of the spool tool of FIGS. 4 and 5 when the corona wire is being strung in a charger.
Figure 7:
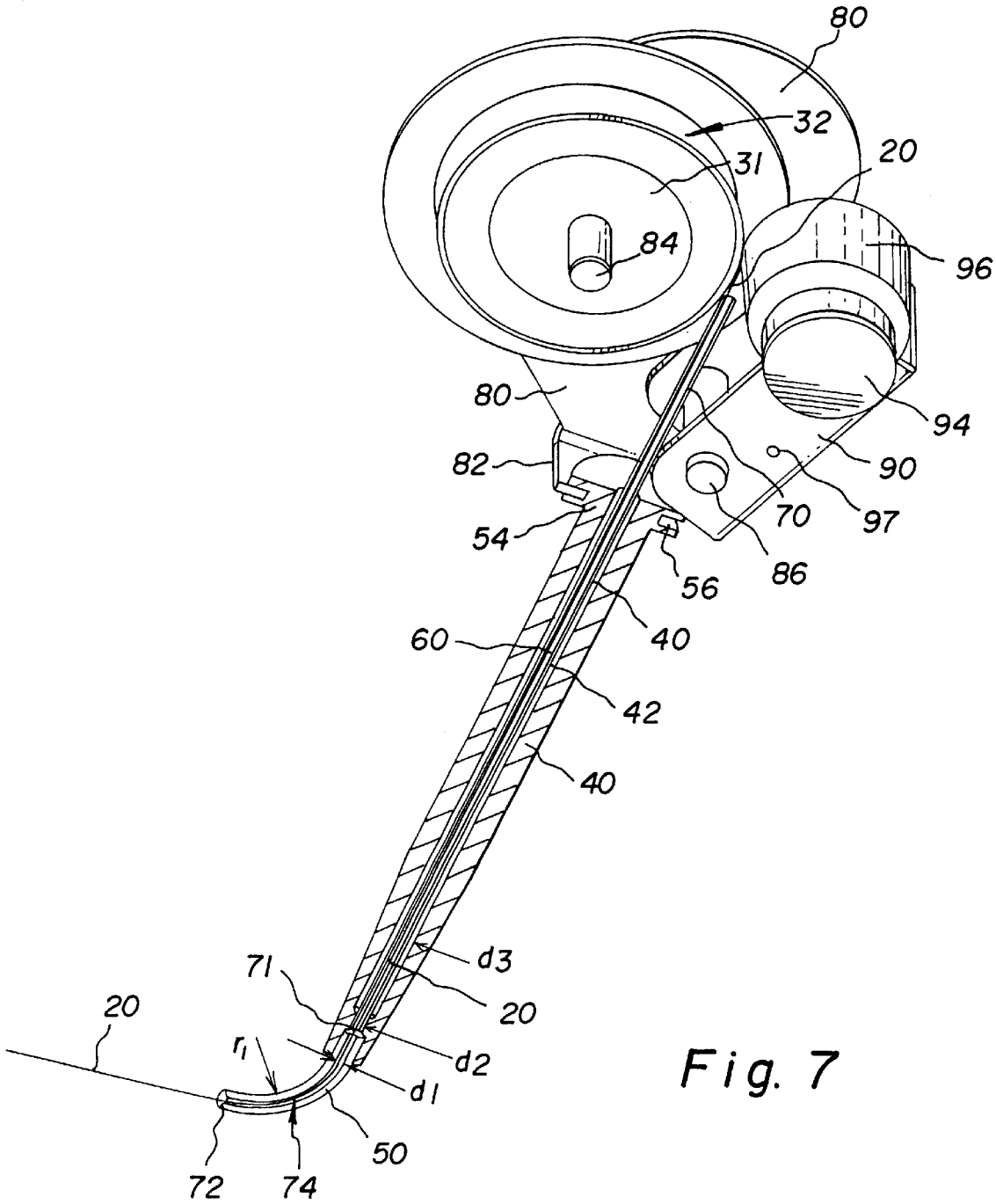
FIG. 7 is a partially cut-out view of the spool tool of FIG. 6 showing the orientation of a wire that is being fed from a spool cylinder into a dispenser pen of the spool tool.
Figure 8:
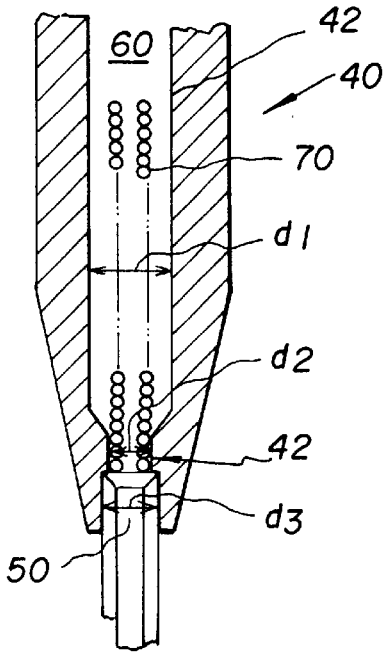
FIG. 8 is an enlarged cross sectional view of a portion of the spool tool shown in FIG. 7 without the wire.
Figure 9:
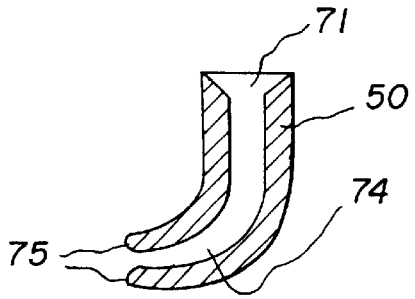
FIG. 9 is a schematic drawing of an enlarged cross section of the radius pipe.

With reference to FIGS. 4, 5, and 6 the spool tool 10 includes a spool 30 with a spool cylinder 32 containing wound wire 20 and supported on a spool carrier 31, and a wire dispenser pen 40 terminating on one end with a radius pipe 50. The other end of the wire dispenser pen 40 has a flange 54 with a groove 56. The wire dispenser pen 40 has inner wall 42 forming a long hollow shaft 60 that is circular in cross section. (See FIG. 7.) In this embodiment the circular cross sections of the shaft 60 (near the output end) are of three different diameters $d_1$, $d_2$, $d_3$ and $d_1>d_2$, $d_3>d_2$. (See FIG. 8.) A flexible pipe 70 is mounted in the shaft 60. It is preferred that the portion of the inner wall 42 forming the smallest diameter ($d_2$) keep the flexible pipe 70 in a press fit connection. This is shown in FIGS. 8 and 9.

One end of the radius pipe 50 is press fit into one end of the shaft 60 and is adjacent to the flexible pipe 70. The radius pipe 50 is curved and has a radius of curvature $r_1$ of 5 mm to 20 mm. When the radius $r_1$ is smaller than about 5 mm the wire transport through the radius pipe 50 is difficult because the stiffness of the wire creates resistance, making it difficult to bend the wire and to push it through the radius pipe 50. When the radius $r_1$ is larger than 20 mm, the radius pipe 50 becomes too large and the spool tool is difficult to handle in the restricted space of a corona charger housing 25. Furthermore, the radius pipe 50 should be curved to provide an approximately 90° angle between its wire entrance opening 71 and the wire exiting opening 72. This angle provides a proper direction for the wire exiting the spool tool and makes it easy to string the corona wire across the corona charger housing 25. If radius $r_1$, is too small, the wire fed through the radius pipe 50 may be forced to bend sharply, resulting in a damaged wire. Furthermore, the smaller the radius $r_1$ the higher is the chance that the corona wire 20, may be deformed permanently, which would cause non-uniformities is the charge created. Ideally the radius $r_1$ should be not smaller than the spool diameter to avoid any further damage to the wire. If the radius $r_1$ is too large the radius pipe 50 becomes too long, making it difficult to string the wire inside the corona charger housing 25.

Figure 10:
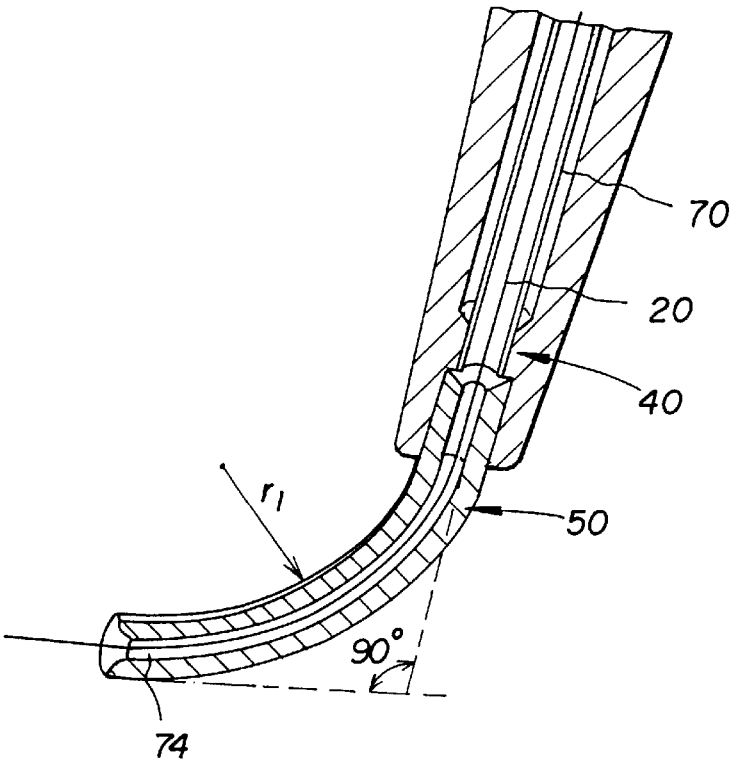
FIG. 10 is an enlarged view of a portion of the spool tool shown in FIG. 8 with the wire that is being fed from a radius pipe.

The radius pipe 50 has a tapered entrance opening 71 from which the wire 20 is fed from the spool tool 10. (See FIG. 9.) The taper is needed so that the wire tip of wire 20 does not jam into the edge of the radius pipe 50, when a new wire is pushed from the flexible pipe 70 into the radius pipe 50. The radius pipe 50 also has an exit opening 72, a central hole 74 connecting the openings 71, 72, and a rounded outer edge 75 (see FIG. 9). The corona wire is directly fed from the flexible pipe 70 into the hole 74 of the radius pipe 50. (See FIGS. 8 and 10). It is preferred that the hole 74 be tapered. The tapered hole 74 allows the wire to freely enter the radius pipe 50 and to provide an appropriate amount of tension when the wire exits the radius pipe 50. The rounded outer edge 75 of the radius pipe 50 protects the wire from bending on the edge.

Because the wire 20 is pushed from the wire spool 30 into the radius pipe 50 (for example, when the spool is replaced), the wire 20 should be constrained very tightly all the way from the spool 30 to the entrance opening 71 of the radius pipe 50, otherwise the wire could kink and jam very easily. However, some flexibility is needed in order to adjust for different spool diameters and positions in the axial directions. The flexible pipe 70 is the most cost effective resolution of these requirements.

It is preferred that the flexible pipe 70 be made of helically wound steel wire. In order to accept corona wires with typical diameters of 0.02 mm to 0.1 mm, it is also preferred that the flexible pipe has an inner diameter of about 0.15 to 1.5 mm and preferably 0.5 mm to 1.5 mm. The flexible pipe 70 may also be made from other materials, but steel is preferred because helically wound steel wire is manufactured easily and is inexpensive.

Figure 11:
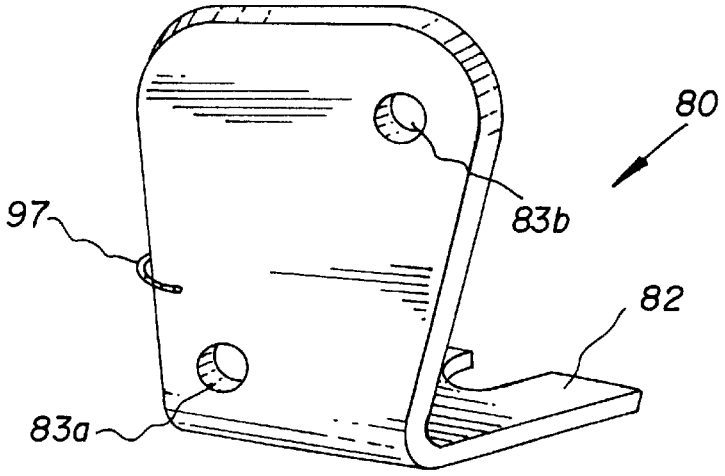
FIG. 11 illustrates the base of the spool tool of FIG. 4.

The spool tool 10 also comprises a base 80 (see FIG. 11.) The base 80 is mounted to the wire dispensing pen 40, for example, with a snap in connection feature such as snap plate 82, which fits inside the groove 56 of the flange 54. (See FIGS. 4, 5, 7.) Other means of attaching the base to the wire dispenser pen may also be used.

Figure 12:
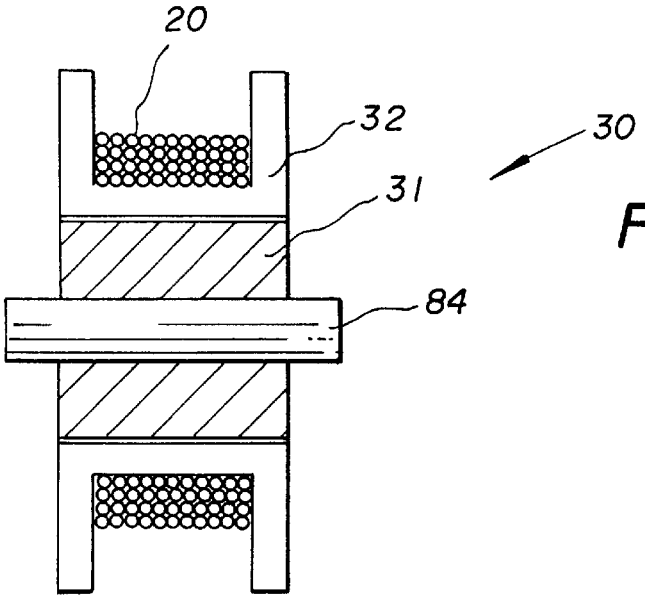
FIG. 12 is a schematic cross section of the spool use in the spool tool of FIG. 4.

The base 80 has holes 83A and 83B. First and second pins 84, 86 are mounted on the base 80 through the holes 83A and 83B. The spool carrier 31 has a cylindrical hole 87 and the first pin 84 is inserted therethrough. The spool carrier 31 rotates relative to the first pin 84. The spool cylinder 32 is supported by the spool carrier 31 and is rotably mounted around the pin 84. (See FIG. 12.) The second pin 86 supports the lever 90 which holds the pin 92. (See FIG. 4.)

Figure 13:
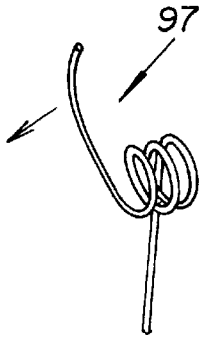
FIG. 13 illustrates a leg spring utilized in the spool tool of FIG. 4.

A cylindrical spool driver 94, preferably made of plastic, and a spool roller 96, preferably made of a foam material or soft rubber material, are mounted on the pin 92. Making the cylindrical spool driver 94 of plastic makes it light weight and inexpensive to produce. Making the cylindrical spool roller 96 of a foam material results in a compliant surface with a high friction coefficient that is needed to drive the spool safely and reliably without damaging the wire 20. A leg spring 97, shown in FIG. 13, pushes the spool roller 96 via lever 90 and pin 92 against the spool cylinder 32. The leg spring is located between the lever 90 and the base 80.

To put in a new spool 30 of corona wire 20 into the spool tool 10 the free end of the corona wire is first fed manually into the flexible pipe 70 until the end appears at the exit opening 72 of the radius pipe 50. Then the lever 90 is lifted from the spool carrier 31 and the wire supply spool 30 is pushed on the spool carrier 31 so that the wire 20 is oriented as shown in FIG. 7. Then the lever 90 is released so that the spool roller 96 touches the spooled corona wire 20. Now corona wire 20 is pulled through the flexible pipe 70 and out of the radius pipe 50 (for the length of about 20 cm–30 cm) until untouched corona wire reaches the exit opening 72 of the radius pipe 50. The wire 20 is now cut at the exit opening 72. The spool tool 10 is now loaded and is ready for use.

Figure 1:
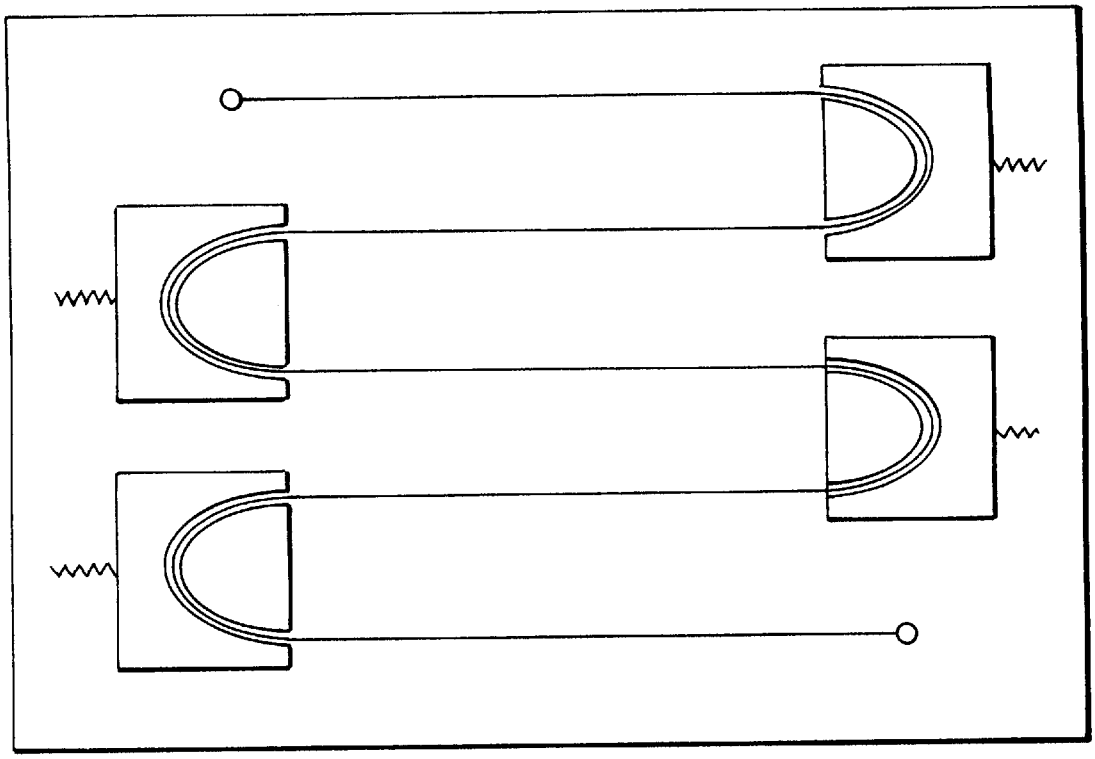
Fig. 1 PRIOR ART
FIG. 1 illustrates a prior art corona charger.
Figure 3:
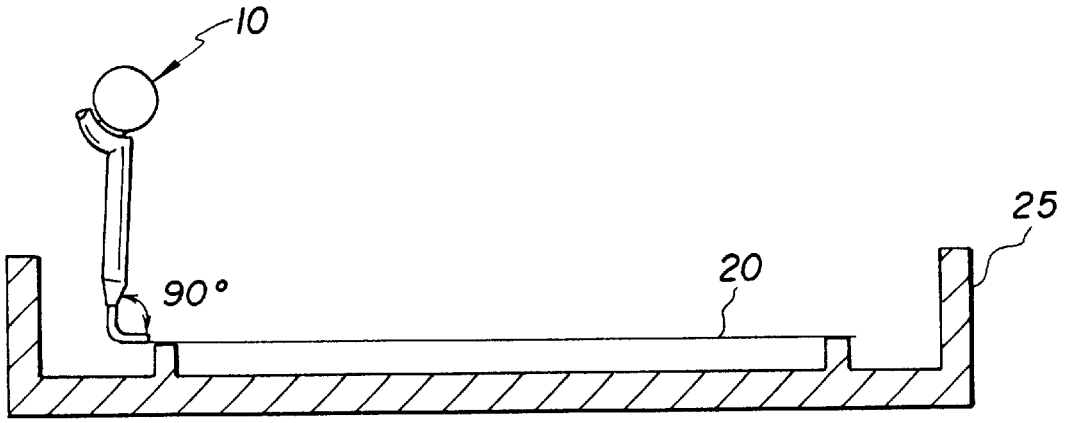
FIG. 3 illustrates a corona charger housing and a corona wire provided by the spool tool of FIG. 2.
Figure 2:
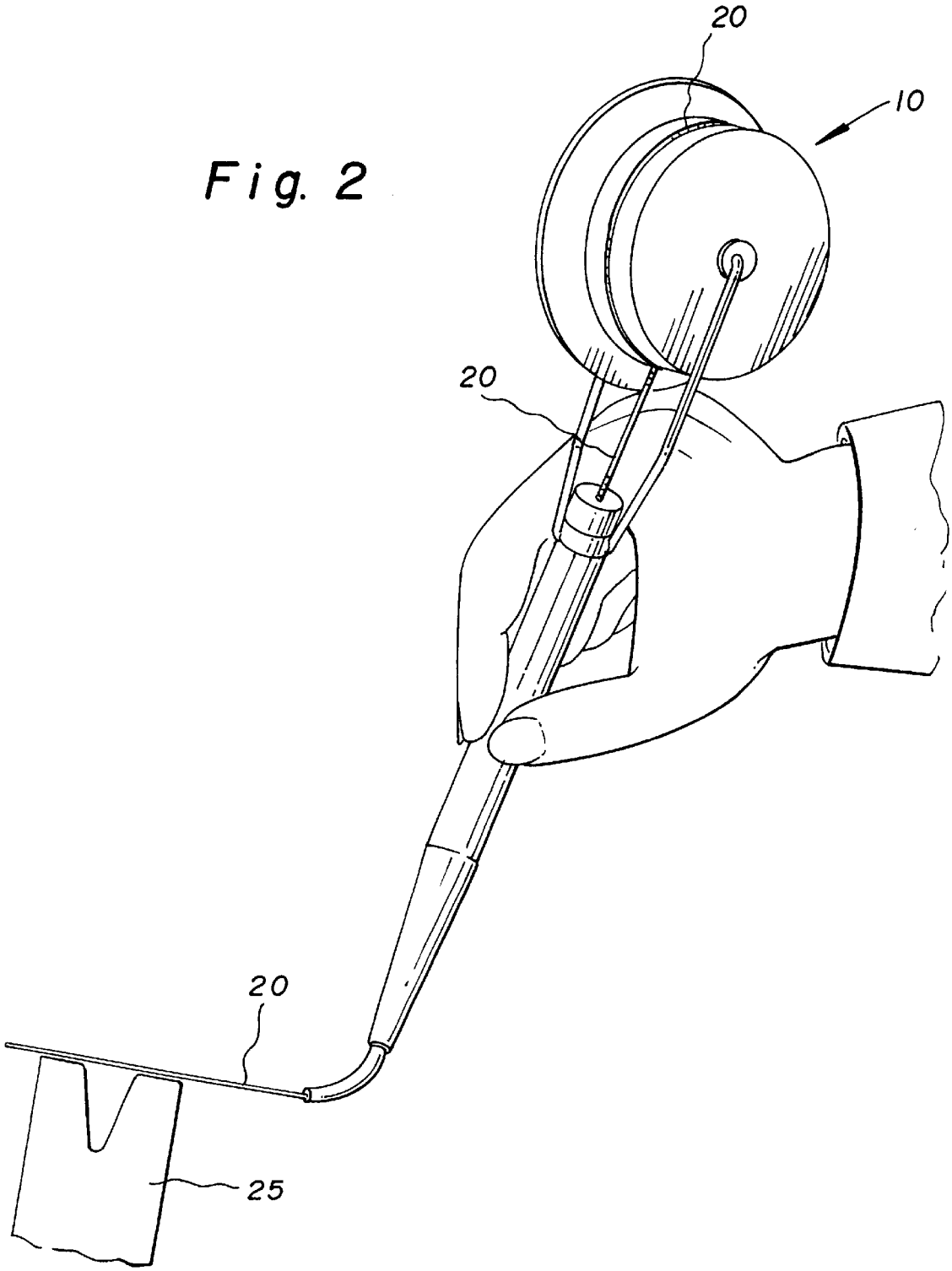
FIG. 2 is a schematic view of a spool tool as it is being used to string corona wire in a corona charger housing.

The handling of the spool tool 10 is similar to the handling of a ballpoint pen or a pencil (see FIG. 2). Only instead of drawing lines on paper, the corona wire is stretched and mounted in a corona charger housing 25 (FIG. 3). The main interface of the spool tool 10, the wire dispenser pen 40, is held like a ballpoint pen. In order to string a corona wire into a corona charger housing 25 the corona wire 20 is fed 1 cm–2 cm out of the exit opening 72 of the radius pipe 50 by turning the spool driver 94 in a draw direction indicated by an arrow in FIG. 6. This end 20*a* of the wire 20 is fixed into the corona charger housing 25. The spool tool 10 is then pulled to the other end of the corona charger housing 25. The spool driver 94 should not be actively turned in this operation. The resistance of the spool tool at rotation of the spool 10 determines the tension during the stringing operation. On the other end of the corona charger housing 25 the spool tool 10 is moved around the wire mount for the second string of wire (and again for a third, fourth, or fifth string of wire) or, if only one string is needed, the second end of the wire is fixed and cut off.

The spool tool 10 accommodates commercially available spools of corona wire. They can be replaced after the wire is used completely or a different type of wire is needed. The wire can be fed out of the radius pipe 50 and mounted into the charger with minimum impact on the wire. The main advantage of this spool tool 10 is the safe and fast mounting of the wire.

More specifically, according to the preferred embodiment of the present invention, a method for mounting a corona wire 20 into the corona charger housing 25 comprises the steps of (i) supporting a spool tool 10 including a spool 30 and wire dispenser pen 40; (ii) feeding a wire 20 out of the wire dispenser pen 40 and securing an open end 20*a* of the wire to a corona charger housing 25; (iii) moving the spool tool 40 to another portion of said corona charger housing 25 while feeding more wire 20 out of the wire dispenser pen 40 and stringing the wire across the corona charger housing 25. It is preferable that prior to securing the second end of the wire 20 said spool tool 40 is moved around at least one wire mount, such as a pulley roller 123*a*, 123*b* or 123*c*, producing at least two strings of corona wire in the corona charger housing 25. (See FIG. 14) This is described in more detail below.

Method of Mounting Corona Wire in a Charger Housing

Figure 14:
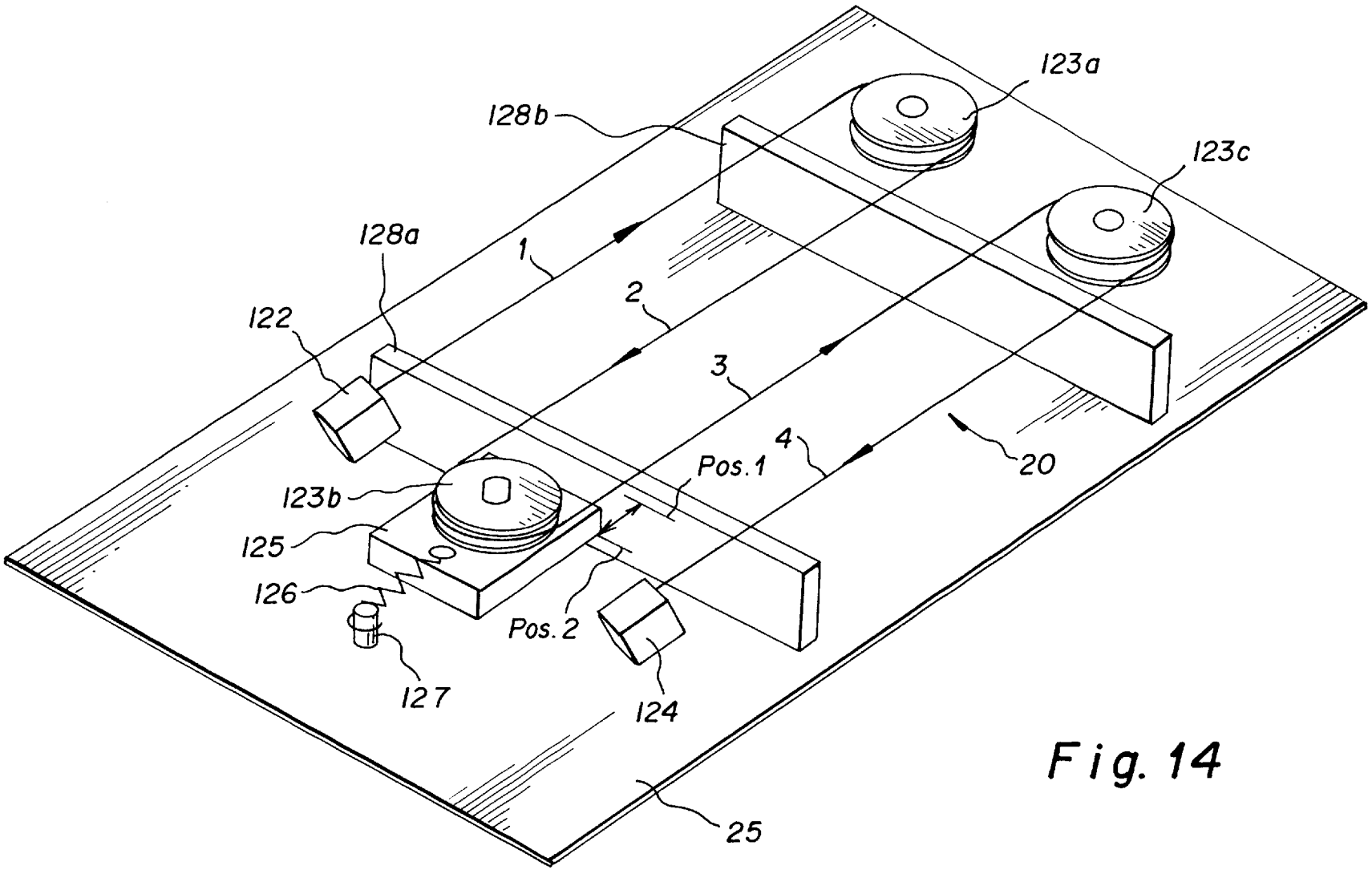
FIG. 14 shows a continuous piece of corona wire forming a serpentine path with four parallel wire strings.

Referring to FIG. 14, a continuous piece of corona wire 20 is mounted along a serpentine path in a corona charger housing 25. First, one end 20*a* of the corona wire is fixed to a start terminal 122 and the corona wire 20 is strung over one or more pulley rollers 123*a*, 123*b*, 123*c* (in a sequence shown by arrows on wire; see FIG. 14). It is preferable, in order to provide a uniform charge, that the corona wire 20 is strung such that strings 1, 2, 3 and 4 of corona wire 20 are parallel to one another. Then, the second end 20*b* of the corona wire 20 is fixed to end terminal 124. One of the pulley rollers 123*b* is mounted on a linearly movable sled 125, tensioned with one tension spring 126. The other pulley rollers 123*a*, 123*c* are fixed to the corona charger housing 25. The pulley rollers 123*a*, 123*b*, 123*c* ensure that the tension of the corona wire 20 is essentially the same over the whole length of the corona wire 20. Thus, only one tension spring 126 is needed to tension two or more strings of a corona wire. The tension spring 126 is secured to the corona charger housing by a mounting pin 127 after the wire 20 is strung to form a serpentine path and after the second end 20*b* is secured into the end terminal 124 of the corona charger housing 25. The tension spring 126 now pulls the sled from position 1 (Pos. 1) to position 2 (Pos. 2). The strings 1, 2, 3 and 4 of wire 20 rest upon two bridges 128*a*, 128*b*. These bridges 128*a*, 128*b* apply minimal deflection to both ends of each wire strings 1, 2, 3, 4 and determine the precise position of each wire string. The start terminal 122, the end terminal 124, the mounting pin 127 of the tension spring 126, bridges 128*a*, 128*b* and the shafts on which the pulley rollers 123*a*, 123*c* are mounted are all connected to the corona charger housing 25.

This serpentine path of the corona wire allows a plurality of wire strings 1, 2, 3, 4 to be strung with minimum variation of tension. As stated above, only one tensioning mechanism (for example, the tension spring 126) is needed to tension two or more strings of corona wire. For example, FIG. 14 shows four strings of corona wire being tensioned with only one spring. This arrangement of mounting and tensioning corona wires on the corona charger housing 25 reduces the number of individual wires, springs, variability in tolerances, and complexity of handling multiple wires from n (where n is the number of individual wire strings, to just one. The tension between individual strings 1, 2, 3, 4 of wire varies only due to variability of friction between the pulley rollers and their shafts, and the friction between the corona wire 20 and bridges 128*a*, 128*b*. Because the friction forces are small compared to tension forces, the variation in the tension is small. Since the most difficult part in mounting the corona wire 20 is the affixation of the wire end, this difficulty is reduced from 10 to 2 in a typical five string wire charger (which has 10 ends). Furthermore, in such five-wire chargers, the number of tension springs is reduced from four or five to one.

It is an advantage of the spool tool that it reduces the number of production steps in building the corona wires and minimizes the chance of damage to the wire and the assembly time.

It is also an advantage of the spool tool of the present invention that it enables mounting of a corona wire directly into the corona charger housing directly from the tool. The wire handling and the danger of damage or contamination during the mounting is reduced to a minimum. The total number of process steps is significantly reduced. No crimping, additional packaging, or unpacking of single fragile wires is necessary.

The invention has been described in detail with particular reference to certain preferred embodiments thereof, but it will be understood that variations and modifications can be effected within the spirit and scope of the invention.

PARTS LIST

10 spool tool
20 corona wire
25 corona charger housing
30 spool
32 spool cylinder
40 dispenser pen
42 inner wall
50 radius pipe
54 flange
56 groove
60 hollow shaft
70 flexible pipe
71 tapered opening of the radius pipe
72 tapered exit opening
74 central hole
75 rounded outer edge
80 base
82 snap plate
84 first pin
86 second pin
87 cylindrical hole
90 lever
92 pin
94 spool driver
96 spool roller
97 leg spring
122 start terminal
123*a, b, c* pulley roller

124 end terminal
125 moveable sled
126 tension spring
127 pin
128*a, b* bridges

What is claimed is:

1. An apparatus comprising:

a wire dispenser pen with an inner wall forming a hollow shaft adapted to receive a wire;

a support structure attached to said wire dispenser pen, said support structure being adapted to receive a spool of wire;

a flexible pipe at least partially extending through said hollow shaft;

wherein said support structure includes a pin adapted to (i) receive and to (ii) rotably support a spool of wire; and said apparatus further includes a rotating spool roller, said spool roller having at least two positions, one of which enables it to be in contact with said spool of wire and the other of which enables the spool of wire to be placed onto said rotating pin and onto said support structure.

2. An apparatus according to claim 1, wherein said wire dispenser pen includes a radius pipe with an exit opening.

3. An apparatus according to claim 2, wherein said radius pipe is curved and the radius $r_1$ curvature of said radius pipe is 5 mm$<r_1<$20 mm.

4. An apparatus according to claim 1, wherein said shaft has a circular cross section.

5. An apparatus according to claim 3, wherein said shaft has a circular cross section.

6. An apparatus according to claim 1, further including a rotatable spool driver, said spool driver being positioned to operatively connect to the spool roller, such that the rotation of said spool driver rotates the spool of wire feeding a wire into said wire dispenser pen.

7. An apparatus comprising:

spool of wire;

a support structure adapted to receive and rotatably support said spool of wire;

a wire dispenser pen capable of attaching to said support structure, said wire dispenser pen having an inner wall forming a hollow shaft adapted to receive a wire from said spool of wire;

a flexible pipe for containing a wire pulled from said spool of wire; and a radius pipe receiving said wire from said flexible pipe, said radius pipe having an exit opening for said wire to exit from said wire dispenser pen; and a lever, said lever supporting a spool roller, said lever being capable of assuming a first position, wherein said spool roller contacts said spool of wire or a second position, wherein said spool roller is positioned away from said spool of wire.

8. An apparatus according to claim 7, wherein said spool of wire has a cylindrical outer surface and a bearing inner surface, said bearing inner surface engaging a complimentary surface of said support structure.

9. An apparatus according to claim 7, wherein said radius pipe has a radius of curvature of 5 to 20 mm.

10. An apparatus according to claim 7, wherein said flexible pipe has an inner radius of 0.5 to 1.5 mm.

11. An apparatus according to claim 10, wherein said flexible pipe is made of helically wound steel wire.

12. An apparatus according to claim 7, further including a rotable spool driver, wherein rotation of said spool driver feeds wire from said spool of wire into said wire dispenser pen.

* * * * *